United States Patent [19]

Mitchell et al.

[11] Patent Number: 4,675,578

[45] Date of Patent: Jun. 23, 1987

[54] ELECTRIC VOTIVE LIGHT CONTROLLER

[75] Inventors: Mark J. Mitchell, West Chester, Pa.; Walter H. Weber, Toronto; David R. Stewart, Caledon East, both of Canada

[73] Assignee: Brighter Light Liturgical Furnishings, Inc., West Chester, Pa.

[21] Appl. No.: 779,255

[22] Filed: Sep. 23, 1985

[51] Int. Cl.[4] ..... H05B 37/00

[52] U.S. Cl. ..... 315/315; 315/317; 315/361; 315/362; 315/312; 362/810

[58] Field of Search ..... 315/316, 317, 320, 361, 315/362, 294, 315, 312; 362/810

[56] References Cited

U.S. PATENT DOCUMENTS

| | | | |
|---|---|---|---|
| 2,897,300 | 7/1959 | King | 315/360 |
| 4,177,407 | 12/1979 | Goldstein et al. | 315/312 |
| 4,317,071 | 2/1982 | Murad | 315/312 |
| 4,492,896 | 1/1985 | Jullien | 315/317 |
| 4,593,234 | 6/1986 | Yang | 315/362 |

OTHER PUBLICATIONS

"Elegance in Electric Candles" by Automatic Votive Light Corp. 766-3rd Ave. Brooklyn, New York 11232.

*Primary Examiner*—Harold Dixon

*Attorney, Agent, or Firm*—Ratner & Prestia

[57] ABSTRACT

A microprocessor based controller for electric liturgical lights similar to an array of votive candles including controllable duration of "burn" as well as selective actuation by the user in a variety of modes. The duration of burn for all lights is controlled by a singular timer which is located within the stand supporting the array. Data indicative of the operational state of a light array may also be transferred to a remote light array for continuation of operation at the remote site.

6 Claims, 2 Drawing Figures

ELECTRIC VOTIVE LIGHT CONTROLLER

BACKGROUND OF THE INVENTION

In many religious denominations, worshippers customarily light votive candles in honor or commemoration of certain festivals or events. Typically, such candles burn for a predetermined duration and are displayed within the church on stands capable of holding an array of lit candles.

In many large religious institutions, multiple candle stands are employed in order to satisfy the needs of a great number of congregants. Commonly, several large stands each containing more than fifty lit candles may be used simultaneously.

In recent years, several techniques have been employed to modernize the votive candle. Such devices as oil candles (which burn liquid oil and may be filled and maintained more easily and cheaply than the continued purchase of wax candles) have found favor in religious institutions. Even more recently, electric light bulbs which simulate the yellow and flickering light of a candle have become popular.

Because electric light bulbs do not "burn down" like a candle, some method of controlling the duration of actuation of these light bulbs is needed. Typical of such a method is a mechanical timer which is set for a predetermined duration of burn and extinguishes the light bulb by actuation of a switch at the conclusion of that predetermined time interval. Such a mechanical timing device performs satisfactorily for locations where a uniform time of actuation is desirable. However, most such systems are incapable of being actuated for precisely controlled variable periods. Such mechanical timers are also an integral part of a light stand and are subject to breakage which renders the stand inoperable.

Among the types of electric bulbs used in votive candle stands, the most desirable are neon "flicker flame" bulbs which operate from a 110 volt AC power source. Although low voltage candle type bulbs have been developed, these bulbs commonly fail to faithfully reproduce the light of a wax or oil candle flame as faithfully as the higher voltage bulbs. In systems employing low voltage electrical lights, control of such lights by electrical circuits using solid state timers is known. Such systems typically employ standard solid state timer components such as 555 type devices and are typically operable only for a single predetermined period of time. Such a timer device is started by the actuation of a switch associated with a particular lamp and begins to count down time from a predetermined level. Upon reaching zero, such systems typically switch a power transistor in order to extinguish the particular light associated with a given timer chip.

Although such electronic systems are superior in function and reliability to prior mechanical systems, they still lack certain desirable features and fail to adequately simulate the light of a candle flame due to their use of low voltage bulbs.

SUMMARY OF THE INVENTION

A microprocessor based controller for high voltage electric liturgical lights similar to an array of votive candles including controllable duration of "burn" as well as selective actuation by the user in a variety of modes. The duration of burn for all lights is controlled by a singular timer which is located within the stand supporting the array. Data indicative of the operational state of a light array may be transferred to a remote light array for continuation of operation at the remote site.

BRIEF DESCRIPTION OF THE INVENTION

A self-contained microprocessor controlled electronic votive candle stand. All functions are controlled by a program operating on a microprocessor within the candle stand. A plurality of lights may be selectively actuated in acordance with the wishes of particular worshippers, who may actuate such lights in any of a plurality of different operating modes. A variable actuation period for all lights is controlled by a singular timing device implemented within the microprocessor. Data indicative of remaining burn time and associated with each of the plurality of lights may be transmitted or received by a separate votive candle stand in order to "relocate" the stand.

DETAILED DESCRIPTION OF THE INVENTION

Figure 1:
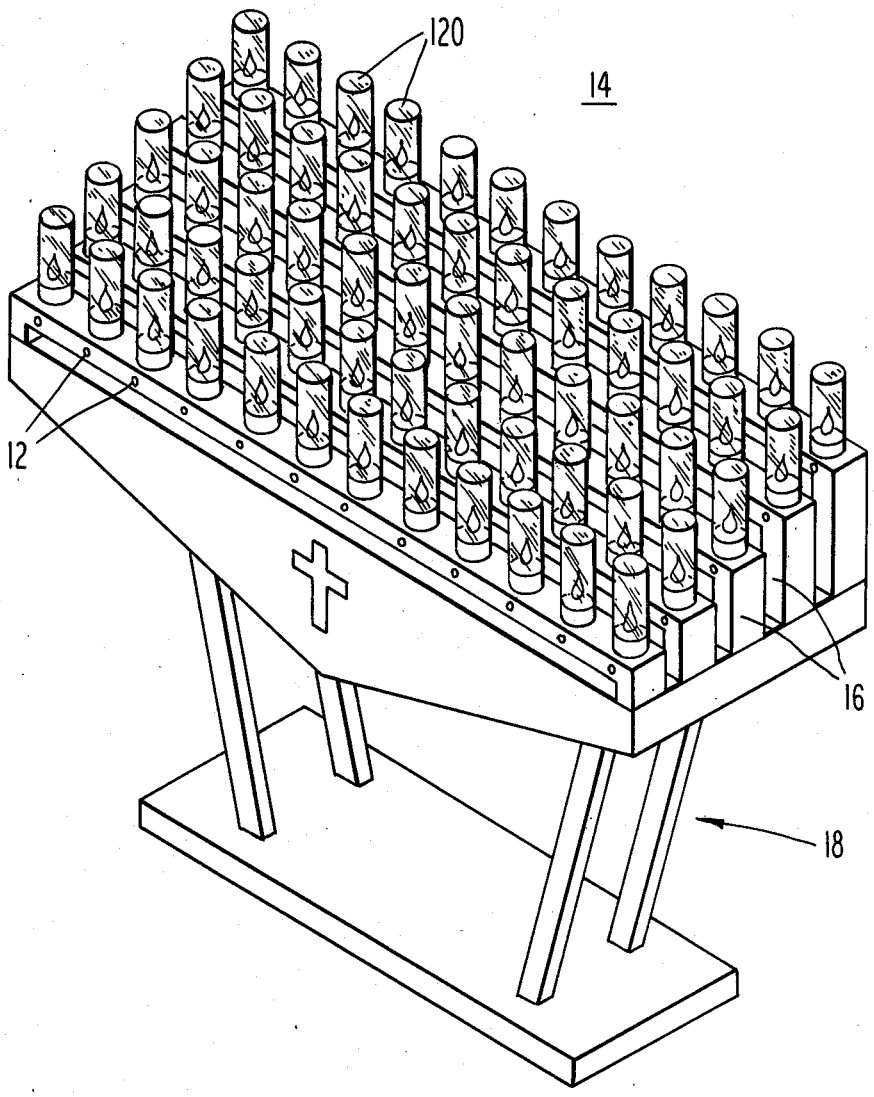
FIG. 1 shows the votive light system of the present invention.

Referring now to FIG. 1, electric votive light controller system 14 is shown supported by stand 18. Electric votive light controller system 14 includes an array of lamps 120 which may be arranged in the form of five rows 16 each containing twelve lamps 120. Corresponding to each lamp 120 there is a key switch 12 on the front of row 16. Each key switch 12 may be used to actuate its corresponding lamp 120 for a predetermined period of time.

Figure 2:
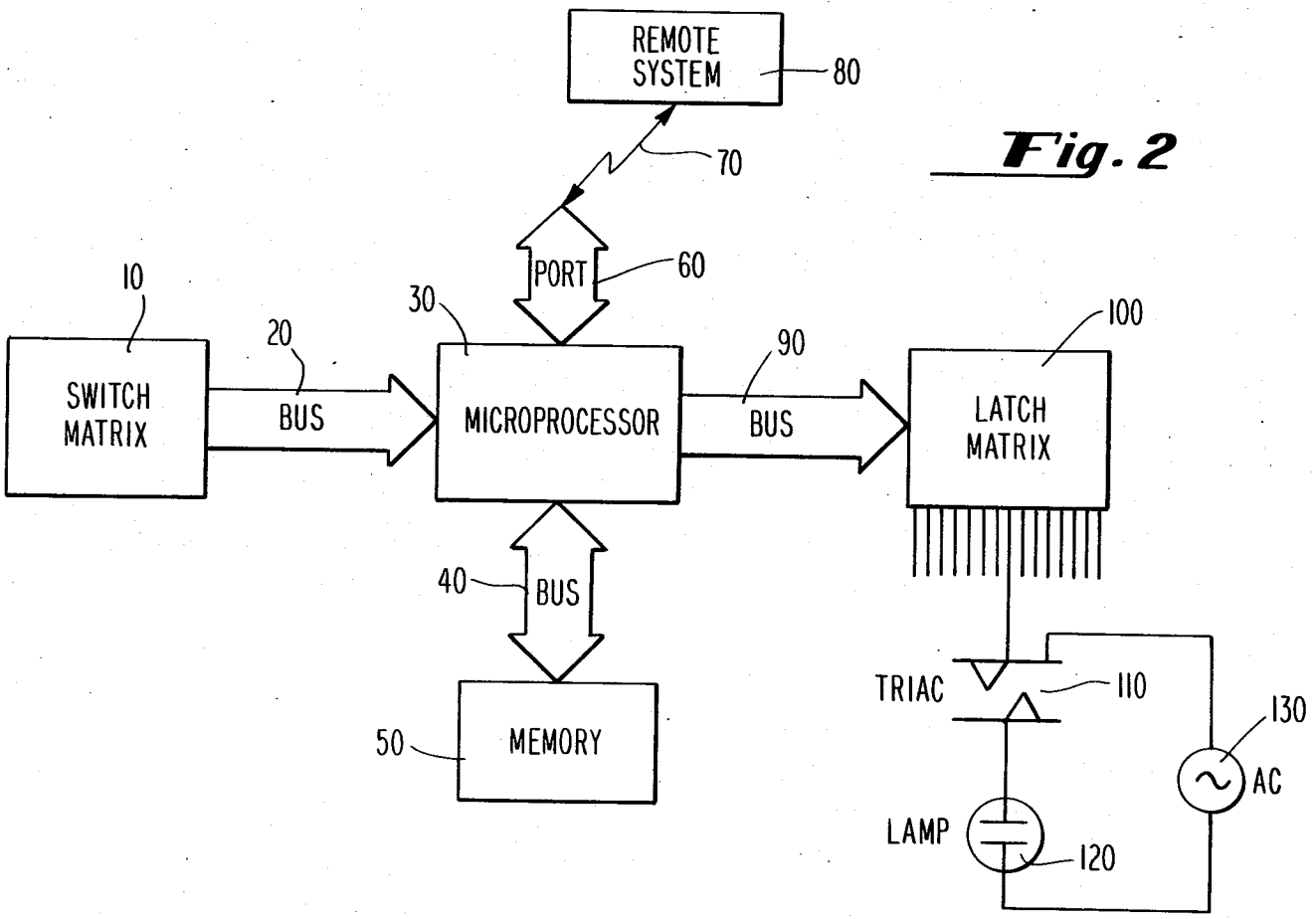
FIG. 2 is a block diagram of the electronic circuitry of the present invention.

Referring now to FIG. 2, there is shown a block diagram of electric votive candle system 14 of the present invention. At the heart of this system is general purpose microprocessor 30 operating under control of a program which is stored in memory 50 connected to microprocessor 30 by way of bidirectional data and address bus 40.

Key switch matrix 10 which comprises a plurality of switches 12 is located on the front of rows 16 as previously described. Each switch 12 is associated with a single lamp 120 and is scanned by microprocessor 30 to determine the identity of an actuated switch. Key switch matrix 10 of five rows and twelve columns provides sixty uniquely addressable key switch locations, each location corresponding to a single switch 12. Thus each switch 12 is associated with a single lamp address which may include the row and column of the associated lamp 120. Lamps 120 of system 14 may be arranged other than in five rows and twelve columns. For example, lamps 120 may be arranged in six rows and ten columns. Key switch matrix 10 is arranged with the same number of rows and columns as lamps 120. The scanning of key switch matrix 10 is accomplished during the MAIN LOOP procedure of the control program.

To control the actuation of a plurality of lamps 120, microprocessor 30 communicates by bus 90 with a plurality of addressable latches in latch array 100. Each addressable latched bit is associated with a switch 12 and is connected to a triac 110, which controls the delivery of 110 volt AC power from AC current source 130 to the addressed lamp 120. Thus when a switch 12 is actuated, the address of its associated lamp 120 is determined by microprocessor 30 and the corresponding latch in latch matrix 100 is addressed using bus 90. Lamp 120 is a neon "flicker flame" bulb. A single AC current source 130 may deliver power to a plurality of lamps 120.

FIG. 2 depicts only one triac 110 and one lamp 120 connected to AC current source 130. In practice, each bit available in latch matrix 100 is connected to a corresponding triac 110 and lamp 120.

Microprocessor 30 is also provided with bidirectional I/O port 60 for communication with other devices such as remote system 80. Commonly, bidirectional port 60 is connected by a pair of conductors to a similar port on remote system 80. Remote system 80 may be an identical votive candle stand, or may be a general purpose microprocessor system of any desired type. Under control of a transfer initiation routine, microprocessor 30 may be directed to transmit information contained in memory 50 via communications link 70 to remote system 80. Information transferred via communications link 70 may include status data such as the designation of each lamp 120 which is lit and its remaining burn time.

The transmission of information occurs in a serial format which is verified for accuracy by the use of complementary data and strobe bits. Such transmission of data is controlled by the TRANSFER TX ROUTINE, while data reception is controlled by the TRANSFER RX ROUTINE. See Appendix. TRANSFER TX ROUTINE and TRANSFER RX ROUTINE may be found in the Appendix which includes a complete pseudo-code listing of a program which may reside in memory 50 to implement the functions of system 15.

To prepare system 14 to receive a transmission, system 14 it is turned off and then back on, causing system 14 to enter an initialization mode. When system 14 is in the initialization mode the three leftmost lamps on the bottommost row 16 remain lit. The switch 12 corresponding to the third lit lamp is depressed causing the system to enter the receive mode. This switch 12 is thus the Receive switch. A Transmit switch (not shown) located on the underside of the transmitting system 14 is then depressed for three seconds. This causes the status data to be transmitted from the transmitting system to the receiving system.

After successful transmission of status data, all lamps 120 of the transmitting electric votive candle control system may be cleared by holding the Transmit switch in the depressed position for five seconds. This permits new data to be entered at switch matrix 10 of the transmitting system using individual switches 12. All data formerly contained within the transmitting control system is executed upon receipt by the receiving control system with no appreciable alteration of lamp burn durations. If the Transmit switch is depressed between three and five seconds the status information is transmitted to the receiving system but is not cleared from the sending system. Thus data is processed at both systems.

A predetermined duration of burn time may be programmed into system 14. To program system 14, power to system 14 is turned off and then turned on causing system 14 to enter the initialization mode. In the initialization mode all lamps 120 are lit for five seconds as a test. When the test period is over, system 14 is programmed using the three leftmost switches 12 on the bottommost row 16. The three leftmost lamps 120, corresponding to these three programming switches, remain lit after the test period to prompt the programmer. The leftmost switch 12 of bottommost row 16 may be used to program the number of days of burn time. System 14 inputs one day for each press of the leftmost switch 12. For example, if the burn duration is to be two days, then the leftmost switch 12 of the bottommost row 16 is pressed two times.

In a similar manner, the second switch 12 from the left of bottommost row 16 is used to program the number of hours of burn duration. For example, if a burn duration of five hours is desired, the second switch 12 from the left of bottommost row 16 is pressed five times.

When the days and hours of burn duration have been entered, the third switch 12 from the left on bottommost row 16 is used as a Set switch. Depressing this Set switch enters into the program of system 14 the number of days and hours indicated by depressing the two leftmost switches 12. Note that this Set switch is the same switch 12 which serves as the Receive switch when no program data is entered on the two leftmost switches 12.

System 14 may include an offering option. The system detects this automatically. When system 14 runs with the offering option installed a user must deposit an offering in an offering box (not shown) before making a candle selection. The presence of the offering box is detected automatically by system 14.

During programming of system 14 the top two rows 16 indicate the status of the programming. Starting from the left of the top row 16 one lamp 120 is lit for each day of burn time programmed. On the second row 16 from the top, one lamp 120 is lit for each hour programmed.

System 14 may also operate in a split mode. When system 14 operates in a split mode the lower two rows 16 and the upper three rows 16 may operate as independent systems in a manner similar to that previously described. The two independent subsystems thus formed may be programmed to have different burn times.

To program system 12 to operate in the split mode, system 14 is placed in the initialization mode as previously described. The burn time for the lower system is selected using the two leftmost buttons of the bottommost row as previously described. The previously described Set switch is not depressed at this point. The burn time for the upper system is then selected by using the two leftmost switches 12 of the the topmost row 16, in which the leftmost switch 12 of the topmost row 16 inputs the days of burn time of the upper system and the second switch 12 from the left inputs the hours of burn time of the upper system. The third button from the left of bottommost row 16 is then used as the Set switch which enters into the program of system 14 the burn times of the upper and lower systems.

In light controller system 14 the following components have been used for the operation and function as described and shown.

| Reference Numeral | Component |
|---|---|
| 30 | MC68705U3 |
| 100 | 4042 |

The following is a listing for the firmware for memory 50. This listing carries out the operations of controller system 14 and is expressed in pseudo code.

APPENDIX

LCR PSEUDO CODE LISTINGS

These listings describe in functional detail the modules and subroutines used by the LCR computer.

They have been written using standard procedures which are outlined at the end of this section.

ROUTINE LIST

DEBUG ENTRY POINTS

RESET/START

CONFIGURE

TRANSFER TX ROUTINE

TRANSFER RX ROUTINE

ERROR RECOVERY ROUTINE

LIGHT INPUT ROUTINE (LIR)

TRANSFER REQUEST ROUTINE (TRR)

BURNTIME INPUT ROUTINE (BIR)

INPUT DECODE

MAIN LOOP

UPDATE

LATCH MODIFY

WRITE LATCH

INITIALIZATION

TIMERSW

PSEUDO CODE STANDARDS

```
------------------
DEBUG ENTRY POINTS
------------------
100 CALL RESET/START          PAGE 200
105 CALL CONFIGURE            PAGE 300
10A CALL TRANSFER TX ROUTINE  PAGE 400
10F CALL TRANSFER RX ROUTINE  PAGE 500
114 CALL LIGHT INPUT ROUTINE  PAGE 600
119 CALL TRANSFER REQUEST     PAGE 700
11E CALL BURNTIME INPUT       PAGE 800
123 CALL INPUT DECODE         PAGE 900
128 CALL MAIN LOOP            PAGE A00
12D CALL UPDATE               PAGE B00
132 CALL LATCH MODIFY         PAGE C00
137 CALL WRITE LATCH          PAGE D00
13C CALL INITIALIZATION       PAGE E00
141 CALL TIMERSW              PAGE F00

-----------
RESET/START
-----------
DISABLE INTERRUPT
CALL INITIALIZATION
START MAIN LOOP

---------
CONFIGURE
---------
SET ALL OF PORT C TO INPUTS
GET DATA FROM PORT C
PUT TEMPORARILY INTO CONFIG IN RAM
CLEAR BIT 6 AND 7 IN CONFIG
LOAD INDEX WITH CONFIG
SHIFT INDEX LEFT ARITHMETICALLY 3 TIMES
GET INITIAL CONFIGURATION FLAGS FROM ROM DIRECTED BY INDEX
PUT INTO CONFIG IN RAM
GET TIME CONTROL REGISTER INIT FROM RAM
PUT INTO TCR
SET PORT B, BIT 0 TO AN INPUT
IF BIT 0 IS SET THEN
  SET UPDATE SELECT FLAG
ENDIF
RESET PORT B TO ALL OUTPUTS
RETURN

-------------------
TRANSFER TX ROUTINE
-------------------
GET DATA DELAY FROM ROM
PUT INTO TIMESW TO DETERMINE TRANSMIT DELAY
CALL TIMERSW
GET TXSTART FROM ROM
PUT INTO TXSTART RAM
PUT START OF TRANSMIT BLOCK INTO TRANSMIT COUNTER (TXC)
GET DATARATE FROM ROM
PUT INTO TCR TO DETERMINE TRANSMIT SPEED
CLEAR PORT C
LOOP
  PUT BIT COUNTER TO 8 BITS
  GET TXWORD USING TXC AS POINTER
```

```
  PUT INTO TXWORD
  LOOP
    LOOP UNTIL TIMER READY
    ENDLOOP
    RESET TIMER BIT
    PUT TXWORD INTO PORT C
    CLEAR STROBE (BIT 1) IN PORT C
    OUTPUT ON BIT 0 AND BIT 1
    LOOP UNTIL TIMER READY
    ENDLOOP
    RESET TIMER BIT
    SET BIT 1 IN PORT C (STROBE)
    OUTPUT ON BIT 0 AND BIT 1
    SHIFT TXWORD ARITHMETICALLY RIGHT ONCE
    DECREMENT BIT COUNTER
  ENDLOOP UNTIL ALL BITS TRANSMITTED (BIT COUNTER=0)
  DECREMENT TRANSMIT COUNTER (TXC)
ENDLOOP UNTIL ALL WORDS TRANSMITTED (TXC=0F)
CLEAR STATUS
GET TCR INIT FROM ROM
PUT INTO TCR
RESET STACK POINTER
START MAIN LOOP

--------------------
TRANSFER RX ROUTINE
--------------------
SET TRANSMIT COUNTER TO START OF MEMORY MOVE (6E)
GET TXSTART FROM ROM
PUT INTO TXWORD
PUT BITCOUNTER TO 8 BITS
SET PORT C BITS AS OUTPUTS
LOOP
  LOOP
    LOOP UNTIL STROBE RECEIVED
    ENDLOOP
    GET GLITCH TIME FILTER VALUE FROM ROM
    LOOP UNTIL GLITCH FILTER READY
    ENDLOOP
  ENDLOOP IF STROBE NOT PRESENT (VALID STROBE)
  GET INPUT DATA FROM PORT C
  COMPARE DATA TO TXSTART USING EXCLUSIVE OR
  ROTATE ACCUMULATOR INTO CARRY BIT
  IF DATA IS NOT AS PREDICTED THEN
    BREAK CALL ERROR RECOVERY ROUTINE
  ENDIF
  ROTATE TXSTART ONCE TO THE RIGHT
  LOOP
  ENDLOOP AS LONG AS STROBE IS PRESENT
  DECREMENT BIT COUNTER (BITC)
ENDLOOP UNTIL ALL BITS RECEIVED
LOOP
  LOOP
    PUT BIT COUNTER TO 8 BITS
    LOOP
      LOOP UNTIL STROBE RECEIVED
      ENDLOOP
      GET GLITCH TIME FILTER VALUE FROM ROM
      LOOP UNTIL GLITCH FILTER READY
      ENDLOOP
```

```
    ENDLOOP IF STROBE NOT PRESENT (VALID STOBE)
    GET INPUT DATA FROM PORT C
    ROTATE ACCUMULATOR INTO CARRY BIT
    ROTATE CARRY BIT INTO TXWORD
    LOOP
    ENDLOOP AS LONG AS STROBE IS PRESENT
    DECREMENT BIT COUNTER (BITC)
  ENDLOOP UNTIL ALL 8 BITS RECEIVED
  GET TXWORD
  PUT TXWORD INTO RAM AT LOCATION IN TXC
  DECREMENT TRANSMIT COUNTER (TXC)
ENDLOOP UNTIL TRANSMIT COUNTER IS AT $0F
CALL CONFIGURE
RESETSTATUS
RESET STACK POINTER
START MAIN LOOP

-----------------------
ERROR RECOVERY ROUTINE
-----------------------
PUT TIMEOUT VALUE INTO TIMESW
RESET STACK POINTER
CALL TIMERSW
START TRANSFER RX ROUTINE

--------------------
LIGHT INPUT ROUTINE
--------------------
GET KEYDATA
PUT INTO INDEX
IF LCRX IS NOT ALREADY LIT THEN
  PUT INDEX INTO LCR POINTER
  SET LATCH DRIVER
  CALL LATCH MODIFY ROUTINE
  RESET LATCH DRIVER
  CALL WRITE LATCH ROUTINE
  CLEAR ACCUMULATOR
  SET CARRY
  GET ROW FROM RAM
  LOOP
    ROTATE ROW LEFT
    CLEAR CARRY
    DECREMENT INDEX
  ENDLOOP WHILE SHIFTS DO NOT EQUAL ROWS
  'AND' MASK WITH CONFIGURATION FLAGS
  IF FLAGS SAY USE LOWER TIMING THEN
    GET BURNTIME 1
  ELSEIF FLAGS SAY USE UPPER TIMING THEN
    GET BURNTIME 0
  ENDIF
  GET LCR COUNTER INTO INDEX
  PUT BURNTIME (X) INTO LCR USING LCRC AS POINTER
  CLEAR LIGHT INPUT FLAG (LIF)
ENDIF
RETURN

-------------------------
TRANSFER REQUEST ROUTINE
-------------------------
START TRANSFER TX ROUTINE
```

```
----------------------
BURNTIME INPUT ROUTINE
----------------------
IF SET BUTTON HAS BEEN PUSHED THEN
  IF NO TIME HAS BEEN RECEIVED FROM UPPER LEVEL THEN
    IF NO TIME HAS BEEN RECEIVED FROM LOWER LEVEL THEN
      CLEAR ALL LIGHTS EXCEPT THE SET LIGHT
      CALL WRITE LATCH
      START TRANSFER RX ROUTINE
    ELSE
      RETURN
    ENDIF
  ELSEIF TIME HAS BEEN RECEIVED FROM LOWER LEVEL
    IF TIME HAS BEEN RECEIVED FROM UPPER LEVEL
      LOOP
        LOAD INDEX WITH # OF REGISTERS TO CLEAR
        CLEAR LATCH REGISTERS USING INDEX
        DECREMENT INDEX
      ENDLOOP UNTIL ALL REGISTERS CLEARED
    ENDIF
  ENDIF
  INCREMENT UPPER BURNTIME
  INCREMENT LOWER BURNTIME
  CALL WRITE LATCH
  CLEAR STATUS FLAGS
  RETURN
ELSEIF THE STAND IS SPLIT
  IF UPPER LARGE INPUT BUTTON PUSHED THEN
    GET LARGE INCREMENT FROM ROM
    ADD WITH BURNTIME
    PUT INTO BURNTIME
    SET UPPER INPUT FLAG
    GET INPUT COUNTER LG 0
    PUT INTO KEYDATA
    INCREMENT COUNTER
    IF COUNTER IS LESS THAN MAX ALLOWED THEN
      CALL LIGHT INPUT ROUTINE
    ENDIF
  ELSEIF UPPER SMALL INPUT BUTTON PUSHED THEN
    GET LARGE INCREMENT
    ADD WITH BURNTIME
    PUT INTO BURNTIME
    SET UPPER INPUT FLAG
    GET INPUT COUNTER SM 0
    PUT INTO KEYDATA
    INCREMENT COUNTER
    IF COUNTER IS LESS THAN MAX ALLOWED THEN
      CALL LIGHT INPUT ROUTINE
    ENDIF
  ENDIF
ENDIF
IF LOWER LARGE INPUT BUTTON PUSHED THEN
  GET LARGE INCREMENT FROM ROM
  ADD WITH BURNTIME
  PUT INTO BURNTIME
  SET LOWER INPUT FLAG
  GET INPUT COUNTER LG 1
  PUT INTO KEYDATA
  INCREMENT COUNTER
```

```
  IF COUNTER IS LESS THAN MAX ALLOWED THEN
    CALL LIGHT INPUT ROUTINE
  ENDIF
ELSEIF LOWER SMALL INPUT BUTTON PUSHED THEN
  GET LARGE INCREMENT
  ADD WITH BURNTIME
  PUT INTO BURNTIME
  SET LOWER INPUT FLAG
  GET INPUT COUNTER SM 1
  PUT INTO KEYDATA
  INCREMENT COUNTER
  IF COUNTER IS LESS THAN MAX ALLOWED THEN
    CALL LIGHT INPUT ROUTINE
  ENDIF
ENDIF
------------
INPUT DECODE
------------
CALCULATE KEYDATA USING ROW AND COLUMN
PUT IN KEYDATA REGISTER
IF HELDKEY IS NOT SET THEN
  SWITCH SYSTEM FLAGS (STATUS)
    CASE BURNTIME INPUT FLAG
      CALL BURNTIME INPUT ROUTINE
    ENDCASE
    CASE TRANSFER REQUEST FLAG
      START TRANSFER TX ROUTINE
    ENDCASE
    CASE LIGHT INPUT FLAG
      CALL LIGHT INPUT ROUTINE
    ENDCASE
  ENDSWITCH
ENDIF
SET HELDKEY
RETURN
---------
MAIN LOOP
---------
LOOP WITH NO EXIT
  PUT MAXIMUM COL# INTO TEMP
  GET MASK
  PUT MASK INTO STROBE/BIT MASK
  PUT MASK ON ROW OUTPUTS
  PUT ROW TO ZERO
  LOOP
    PUT COL TO ZERO
    SET PORT C FOR OFFERING INPUT (BIT 2)
    LOOP UNTIL TIMER SET
      IF OFFERING SET THEN
        SET LIGHT INPUT FLAG (LIF)
      ELSEIF INTERRUPT LINE LOW THEN
        SET TRANSFER REQUEST FLAG
      ENDIF
    ENDLOOP
    RESET TIMER
    SET PORT C OUTPUTS AND INPUTS
    IF TRANSFER REQUEST FLAG SET THEN
      CALL INPUT DECODE
```

```
    ENDIF
    SWITCH PORT C DATA
      CASE COL0|COL1|COL2|COL3|COL4|COL5|
           COL6|COL7|COL8|COL9|
        BREAK CALL INPUT DECODE
      ENDCASE
      CASE DEFAULT
        DO NOTHING
      ENDCASE
    ENDSWITCH
    SET NEXT ROW HIGHER
    GET NEW MASK
    PUT NEW MASK TO ROW OUTPUTS
  ENDLOOP UNTIL ROW IS AT ROWMAX
  RESET HELDKEY
  CALL WRITE LATCH
  DECREMENT UPDATE
  IF UPDATE IS ZERO THEN
    BREAK CALL UPDATE
  ENDIF
ENDLOOP
------
UPDATE
------
SWITCH UPDATE SELECT FLAG
  CASE FLAG SET
    GET UPDATE1 FROM ROM
    PUT INTO UPDATE
    GET TIME INC1
    PUT INTO TIME INC
  ENDCASE
  CASE FLAG RESET
    GET UPDATE0 FROM ROM
    PUT INTO UPDATE
    GET TIME INC0
    PUT INTO TIME INC
  ENDCASE
ENDSWITCH
SET TOP OF LCR
LOOP
  IF LCR CONTENT IS NOT ZERO THEN
  ELSEIF LCR CONTENT IS NOT ONE THEN
    DECREMENT CONTENT OF LCR
  ELSE
    CALL LATCH MODIFY
    CALL WRITE LATCH
  ENDIF
DECREMENT POINTER TO SELECT NEW LCR
ENDLOOP UNTIL OUT OF LCR'S
RETURN
------------
LATCH MODIFY
------------
GET LCR POINTER FROM RAM
CALCULATE LATCH NUMBER USING OCTAL ROUTINE
CALCULATE BIT NUMBER USING OCTAL ROUTINE
PUT LATCH NUMBER INTO LATCH POINTER
PUT BIT NUMBER INTO LBIT
PUT LATCH INTO TEMPORARY REGISTER
```

```
PUT FIRST MASK INTO STROBE/BIT MASK
LOOP UNTIL BIT IS SELECTED
  ROTATE MASK TO SELECT NEW BIT
  DECREMENT BIT COUNTER
ENDLOOP
LOAD BIT MASK CHOSEN
SWITCH LATCH DRIVER FLAG
  CASE FLAG OFF
    COMPLEMENT MASK
    RESET BIT IN LATCHX USING AND FUNTION
    PUT BACK INTO LATCHX
  ENDCASE
  CASE FLAG ON
    SET BIT IN LATCHX USING OR FUNCTION
    PUT BACK INTO LATCHX
  ENDCASE
ENDSWITCH
GET INDEX REGISTER FROM TEMPORARY REGISTER
RETURN
-----------
WRITE LATCH
-----------
PUT STROBE DATA INTO STROBE MASK
SET ALL OF PORT B TO OUTPUTS
SET LATCH POINTER TO FIRST LATCH
LOOP
  GET LATCH DATA
  PUT ON DATA BUS (PORT B)
  GET STROBE DATA
  PUT ON STROBE OUTPUTS (PORT A)
  CLEAR STROBE OUTPUTS
  CLEAR DATA OUTPUTS
  INCREMENT TO NEXT LATCH
  ROTATE MASK FOR NEXT LATCH
ENDLOOP WHILE LATCHES ARE LEFT
RETURN
--------------
INITIALIZATION
--------------
CLEAR MEMORY (RAM)
SET BURNTIME INPUT FLAG
PUT INITIAL DATA CONTROL REGISTER DATA INTO DDR'S
              (A:3F B:FF C:FF)
SET LATCH0 TO LATCH7 TO ALL ON
CALL WRITE LATCH
CALL TIMER USING 5 SECONDS
CALL CONFIGURE
CALL UPDATE
GET BURNTIME INPUT LATCH PATTERN FROM ROM
PUT INTO LATCH VARIABLES
IF CONFIGURATION NOT SPLIT THEN
  CLEAR LATCH 0
ENDIF
CALL WRITE LATCH
GET TIME INPUT INDICATOR LOCATIONS FROM ROM
PUT INTO INDICATOR COUNTERS IN RAM
RETURN
```

```
-------
TIMERSW
-------
LOOP
    LOOP UNTIL TIMER SET
    ENDLOOP
  RESET TIMER
ENDLOOP UNTIL TIMERSW ZERO
RETURN
```

PSEUDO CODE STANDARDS

This section describes the conventions for the design and writing of programs in PDL (PROGRAM DESIGN LANGUAGE OR PSEUDO-CODE).

The following VERBS are used in PDL.

| | | |
|---|---|---|
| ATTACH | | |
| DETACH | | |
| GET | FROM | USING |
| PUT | ON | |
| OPEN | AS | |
| CLOSE | | |
| EXIT WITH STATUS | | |
| CALCULATE | USING | |
| SORT | BY | |
| SEARCH | FOR | |
| SEND | TO | |
| START | | |
| STOP | | |
| ABORT | | |
| WAIT FOR | | |
| ENCODE | IN | |
| DECODE | FROM | |
| CALL | | |
| SET | | |
| RESET | | |

ENABLE

DISABLE

CLEAR

DECREMENT

INCREMENT

The following DATA STRUCTURE names are used in PDL.

ARRAY

QUEUE

STACK

RECORD

SEQUENTIAL FILE

RANDOM FILE

Also these primative names are used.

CHARACTER

STRING

INTEGER

REAL

COMPLEX

The specification of a data structure should contain both the structure type and the data type, for example:

```
xyz:ARRAY OF INTEGER
ABC:QUEUE OF STRING
```

The following CONTROL STRUCTURES are used in PDL.

| | |
|---|---|
| ISR | Interrupt Service Routine |
| ENDISR | End Routine |
| TSR | Trap Service Routine |
| ENDTSR | End Routine |

```
LOOP              Repetitive constructs
ENDLOOP           End of repetitive construct

LOOP WHILE        Test at start of loop
ENDLOOP

LOOP              Test at end of loop
ENDLOOP WHILE

LOOP FOR TO BY    Use index variable
ENDLOOP

IF THEN           Do if true
ELSEIF THEN       Or do if this is true
ELSE              If above not true do this
ENDIF             End of decision construct
RETURN            End of subroutine
SWITCH            What you will be looking at
  CASE            The case you are looking for
  ENDCASE         End of this particular case
ENDSWITCH         End of the entire investigation
```

We claim:

1. An electric votive light controller system having a plurality of lamps each lamp having an individual lamp address and a switching matrix having a plurality of switches, each switch associated with only one lamp comprising:

control means coupled to each of the lamps for actuating the lamps in response to a closing of the switch associated with each respective lamp; and the control means including timing means for turning off each lamp a programmable predetermined period of time after its actuation.

2. The system of claim 1 in which the timing means includes singular timing means for determining the duration of the predetermined period of time independently for each lamp.

3. The system of claim 1 in which the switching matrix comprises a switching array having rows and columns and the control means includes means for polling the rows and columns to determine the lamp address associated with an actuated switch.

4. The system of claim 3 in which there is further provided a latch matrix including a plurality of latches each latch associated with one switch and coupled to one lamp in which a latch activates a lamp in accordance with the determined lamp address.

5. The system of claim 1 including transmission means coupled to the control means for transferring status information from the controller to a remote system.

6. The system of claim 1 in which the controller means includes split mode means for permitting the system to operate as two independent systems.

* * * * *